US010863791B2

(12) United States Patent
Iglesias et al.

(10) Patent No.: US 10,863,791 B2
(45) Date of Patent: Dec. 15, 2020

(54) REMOVABLE LEG WALKER

(75) Inventors: Joseph Michael Iglesias, Agoura Hills, CA (US); Tracy E. Grim, Agoura Hills, CA (US)

(73) Assignee: Ovation Medical, Agoura Hills, CA (US)

( * ) Notice: Subject to any disclaimer, the term of this patent is extended or adjusted under 35 U.S.C. 154(b) by 0 days.

(21) Appl. No.: 13/441,552

(22) Filed: Apr. 6, 2012

(65) Prior Publication Data

US 2012/0255204 A1 Oct. 11, 2012

Related U.S. Application Data

(60) Provisional application No. 61/472,946, filed on Apr. 7, 2011.

(51) Int. Cl.
*A43B 13/14* (2006.01)

(52) U.S. Cl.
CPC ..... *A43B 13/145* (2013.01); *A43B 13/143* (2013.01)

(58) Field of Classification Search
CPC .. A43B 7/142; A43B 7/22; A43B 7/00; A43B 13/12; A43B 13/141; A61F 5/0195; A61F 5/011; A61F 5/0585; A61F 13/14; A61F 13/06; A61F 13/066
USPC ..... 36/140, 155, 110, 103; 602/23, 61, 65
See application file for complete search history.

(56) References Cited

U.S. PATENT DOCUMENTS 143,537 A 10/1873 Silberschmidt
1,472,415 A 10/1923 Haggerty
2,643,468 A 6/1953 Gottschalk
2,959,169 A 11/1960 Bless
3,464,126 A 9/1969 Sarkissian
3,504,668 A 4/1970 Boudon
3,661,151 A 5/1972 Schoenbrun et al.
3,665,619 A 5/1972 Gray
3,792,537 A 2/1974 Plank et al.
3,805,773 A 4/1974 Sichau
3,814,088 A 6/1974 Raymond
3,955,565 A 5/1976 Johnson
3,976,059 A 8/1976 Lonardo
4,005,704 A 2/1977 Stöhr et al.
4,053,995 A 10/1977 Shein
4,057,056 A 11/1977 Payton
4,094,312 A 6/1978 Whyte
(Continued)

FOREIGN PATENT DOCUMENTS

CN 201085714 Y 7/2008
CN 201523712 U 7/2010
(Continued)

OTHER PUBLICATIONS

International Preliminary Report on Patentability for International application No. PCT/US2012/032710 dated Oct. 17, 2013 from the International Bureau of WIPO.
(Continued)

*Primary Examiner* — Megan E Lynch
(74) *Attorney, Agent, or Firm* — Fulwider Patton LLP

(57) ABSTRACT

An orthopedic walking boot for a user includes an outer sole having a substantially continuously curved lateral profile bottom walking surface, wherein a radius of curvature of the lateral walking surface varies between 10 mm and infinity, and an upper portion arranged with the outer sole to support a lower portion of the user's leg.

2 Claims, 4 Drawing Sheets

(56) References Cited

U.S. PATENT DOCUMENTS 4,100,686 A 7/1978 Sgarlato et al.
4,100,918 A 7/1978 Glancy
4,184,273 A 1/1980 Boyer et al.
4,188,735 A 2/1980 Hahn
4,215,491 A 8/1980 Giannetti
4,217,706 A 8/1980 Vartanian
4,265,033 A 5/1981 Pois
4,268,931 A 5/1981 Salomon
4,393,866 A 7/1983 Finnieston
4,446,856 A 5/1984 Jordan
4,454,871 A 6/1984 Mann et al.
4,494,536 A 1/1985 Latenser
4,497,070 A 2/1985 Cho
4,505,269 A 3/1985 Davies et al.
4,510,927 A 4/1985 Peters
4,550,721 A 11/1985 Michel
4,556,054 A 12/1985 Paulseth
4,559,934 A 12/1985 Philipp
4,567,678 A 2/1986 Morgan et al.
4,572,169 A 2/1986 Mauldin et al.
4,587,962 A 5/1986 Greene et al.
4,590,932 A 5/1986 Wilkerson
4,624,247 A 11/1986 Ford
4,628,945 A 12/1986 Johnson, Jr.
4,665,904 A 5/1987 Lerman
4,771,768 A 9/1988 Crispin
4,805,601 A 2/1989 Eischen, Sr.
4,825,856 A 5/1989 Nelson
4,844,094 A 7/1989 Grim
4,862,900 A 9/1989 Hefele
4,872,273 A 10/1989 Smeed
4,879,822 A 11/1989 Hayes
4,919,118 A 4/1990 Morris
4,941,271 A 7/1990 Lakic
4,947,838 A 8/1990 Giannetti
4,964,402 A 10/1990 Grim et al.
4,974,583 A 12/1990 Freitas
4,982,733 A 1/1991 Broadhurst et al.
4,989,349 A * 2/1991 Ellis, III ..... 36/25 R
4,999,932 A 3/1991 Grim
5,020,523 A 6/1991 Bodine
5,078,128 A 1/1992 Grim et al.
5,086,761 A 2/1992 Ingram
5,088,478 A 2/1992 Grim
5,088,479 A 2/1992 Detoro
5,088,481 A 2/1992 Darby
5,092,321 A 3/1992 Spademan
5,125,400 A 6/1992 Johnson, Jr.
5,154,695 A 10/1992 Farris et al.
5,176,623 A 1/1993 Stetman et al.
5,197,942 A 3/1993 Brady
5,213,564 A 5/1993 Johnson, Jr. et al.
5,219,324 A 6/1993 Hall
5,226,245 A 7/1993 Lamont
5,226,875 A 7/1993 Johnson
5,233,767 A 8/1993 Kramer
5,242,379 A 9/1993 Harris et al.
5,277,695 A 1/1994 Johnson, Jr. et al.
RE34,661 E 7/1994 Grim
5,329,705 A 7/1994 Grim et al.
5,330,419 A 7/1994 Toronto
5,334,135 A 8/1994 Grim et al.
5,352,189 A 10/1994 Schumann et al.
5,353,525 A 10/1994 Grim
5,367,789 A 11/1994 Lamont
5,368,551 A 11/1994 Zuckerman
5,370,133 A 12/1994 Darby et al.
5,370,604 A 12/1994 Bernardoni
5,378,223 A 1/1995 Grim et al.
5,383,290 A 1/1995 Grim
5,384,970 A 1/1995 Melton
5,392,534 A 2/1995 Grim
5,399,152 A 3/1995 Habermeyer et al.
5,399,155 A 3/1995 Strassburg et al.
5,407,421 A 4/1995 Goldsmith
5,425,701 A 6/1995 Oster et al.
5,426,872 A 6/1995 Hayes
5,429,588 A 7/1995 Young et al.
5,441,015 A 8/1995 Farley
5,445,602 A 8/1995 Grim et al.
5,460,599 A 10/1995 Davis et al.
5,464,385 A 11/1995 Grim
5,483,757 A 1/1996 Frykberg
5,496,263 A 3/1996 Fuller, II et al.
5,503,622 A 4/1996 Wehr
5,507,720 A 4/1996 Lampropoulos
5,526,586 A 6/1996 Foscaro
5,527,269 A 6/1996 Reithofer
5,551,950 A 9/1996 Oppen
5,554,104 A 9/1996 Grim
5,571,077 A 11/1996 Klearman et al.
5,577,998 A 11/1996 Johnson, Jr. et al.
5,582,579 A 12/1996 Chism et al.
5,609,570 A 3/1997 Lamont
5,617,650 A 4/1997 Grim
5,620,411 A 4/1997 Schumann et al.
5,632,723 A 5/1997 Grim
5,641,322 A 6/1997 Silver et al.
5,675,839 A 10/1997 Gordon et al.
5,720,715 A 2/1998 Eriksson
5,761,834 A 6/1998 Grim et al.
5,762,622 A 6/1998 Lamont
5,772,619 A 6/1998 Corbett
5,776,090 A 7/1998 Bergmann et al.
5,799,659 A 9/1998 Stano
5,823,981 A 10/1998 Grim et al.
5,827,210 A 10/1998 Antar et al.
5,827,211 A 10/1998 Sellinger
5,833,639 A 11/1998 Nune et al.
5,836,902 A 11/1998 Gray
5,853,381 A 12/1998 Stevenson et al.
5,857,987 A 1/1999 Habermeyer
5,865,166 A 2/1999 Fitzpatrick et al.
5,868,690 A 2/1999 Eischen, Sr.
5,887,591 A 3/1999 Powell et al.
5,891,073 A 4/1999 Deirmendjian et al.
5,897,515 A 4/1999 Willner et al.
5,897,520 A 4/1999 Gerig
5,902,259 A 5/1999 Wilkerson
5,913,841 A 6/1999 Lamont
5,925,010 A 7/1999 Caprio, Jr.
5,951,504 A 9/1999 Iglesias et al.
5,954,075 A 9/1999 Gilmour
5,961,477 A 10/1999 Turtzo
5,971,946 A * 10/1999 Quinn et al. ..... 602/27
5,980,475 A 11/1999 Gibbons
5,993,404 A 11/1999 Mc Niel
6,019,741 A 2/2000 Prieskorn
6,021,780 A 2/2000 Darby
6,024,712 A 2/2000 Iglesia et al.
6,027,468 A 2/2000 Pick
6,044,578 A 4/2000 Kelz
6,056,712 A 5/2000 Grim
6,126,625 A 10/2000 Lundberg
6,146,349 A 11/2000 Rothschild et al.
6,154,983 A 12/2000 Austin
6,155,998 A 12/2000 Gilmour
6,189,172 B1 2/2001 Baek
6,228,044 B1 5/2001 Jensen et al.
6,247,250 B1 6/2001 Hauser
6,267,742 B1 7/2001 Krivosha et al.
6,269,554 B1 * 8/2001 Silvestrini et al. ..... 36/144
6,277,087 B1 8/2001 Hess et al.
6,282,816 B1 9/2001 Rosendahl
6,282,818 B1 9/2001 Lu
6,334,854 B1 1/2002 Davis
6,350,246 B1 2/2002 DeToro
6,361,514 B1 3/2002 Brown et al.
6,361,515 B1 3/2002 Gilmour
6,374,516 B1 4/2002 Bonaventure et al.
6,406,450 B1 6/2002 Kowalczyk et al.
6,409,695 B1 6/2002 Connelly
6,432,073 B2 8/2002 Prior et al.
6,491,654 B2 12/2002 Lamont

(56) References Cited

U.S. PATENT DOCUMENTS

D473,654 S 4/2003 Iglesias et al.
6,558,339 B1 5/2003 Graham
6,572,571 B2 6/2003 Lowe
6,648,843 B1 11/2003 Marciano et al.
6,656,145 B1 12/2003 Morton
6,682,497 B2 1/2004 Jensen et al.
6,699,209 B2 3/2004 Turtzo
6,711,834 B1 3/2004 Kita
6,722,060 B2 4/2004 Okajima
6,755,798 B2 6/2004 McCarthy et al.
6,793,638 B1 * 9/2004 DeToro et al. ..... 602/23
6,796,058 B2 9/2004 Potchatko
D500,855 S 1/2005 Pick et al.
6,866,043 B1 3/2005 Davis
6,923,780 B2 8/2005 Price et al.
6,945,946 B2 9/2005 Rooney
6,945,947 B2 9/2005 Ingimundarson et al.
6,955,654 B2 10/2005 Gilmour
6,976,972 B2 12/2005 Bradshaw
6,979,287 B2 12/2005 Elbaz et al.
6,991,613 B2 1/2006 Sensabaugh
7,018,351 B1 3/2006 Iglesias et al.
7,018,352 B2 3/2006 Pressman et al.
D519,211 S 4/2006 Doty et al.
7,077,818 B2 7/2006 Ingimundarson et al.
7,163,518 B1 1/2007 Roche et al.
7,163,519 B2 1/2007 Price et al.
7,182,743 B2 2/2007 Slautterback et al.
D541,085 S 4/2007 Marsilio
7,288,076 B2 10/2007 Grim et al.
7,291,181 B1 * 11/2007 Lyons et al. ..... 623/33
7,294,114 B1 11/2007 Clement et al.
7,303,538 B2 12/2007 Grim et al.
7,311,686 B1 12/2007 Iglesias et al.
7,354,411 B2 4/2008 Perry et al.
7,384,584 B2 6/2008 Jerome et al.
7,418,755 B2 * 9/2008 Bledsoe et al. ..... 12/142 N
7,475,501 B1 1/2009 DeToro et al.
7,563,238 B1 7/2009 Breashears
7,569,022 B2 8/2009 Morinaka
7,585,285 B2 9/2009 Pone et al.
7,597,674 B2 10/2009 Hu et al.
7,666,157 B2 2/2010 Win
D616,556 S 5/2010 Hu
7,727,173 B2 6/2010 Rooney
7,727,174 B2 6/2010 Chang et al.
7,743,532 B2 6/2010 Bledsoe et al.
D619,726 S 7/2010 Win
7,758,529 B2 7/2010 Jensen et al.
7,867,182 B2 1/2011 Iglesias et al.
D634,438 S 3/2011 Hu
7,896,826 B2 3/2011 Hu et al.
7,918,813 B2 4/2011 Drake et al.
7,922,677 B2 * 4/2011 Daiju ..... 602/5
D640,792 S 6/2011 Anderson et al.
D641,084 S 7/2011 Anderson et al.
D642,695 S 8/2011 Anderson et al.
8,002,724 B2 8/2011 Hu et al.
D645,153 S 9/2011 Anderson et al.
8,012,112 B2 9/2011 Barberio
D662,598 S 6/2012 Anderson et al.
8,226,585 B2 7/2012 Pick et al.
8,251,932 B2 8/2012 Fout
8,251,936 B2 8/2012 Fout et al.
2001/0027616 A1 * 10/2001 Silvestrini et al. ..... 36/144
2002/0062579 A1 5/2002 Caeran
2002/0073578 A1 * 6/2002 Ellis, III ..... 36/25 R
2002/0128574 A1 9/2002 Darby
2003/0196352 A1 10/2003 Bledsoe et al.
2004/0015112 A1 1/2004 Salutterback et al.
2004/0030275 A1 2/2004 Morinaka
2005/0016020 A1 * 1/2005 Ellis, III ..... 36/25 R
2005/0131324 A1 * 6/2005 Bledsoe ..... 602/23
2005/0171461 A1 * 8/2005 Pick ..... 602/27
2005/0172517 A1 8/2005 Bledsoe et al.
2005/0228332 A1 10/2005 Bushby
2005/0240133 A1 10/2005 Rooney
2005/0274046 A1 12/2005 Schwartz
2006/0032093 A1 2/2006 Vannini
2006/0048344 A1 3/2006 Cavanagh et al.
2006/0084899 A1 4/2006 Verkade et al.
2006/0189907 A1 8/2006 Pick et al.
2006/0217649 A1 9/2006 Rabe
2007/0010770 A1 1/2007 Gildersleeve
2007/0107267 A1 * 5/2007 Hodgson ..... 36/129
2007/0191749 A1 8/2007 Barberio
2007/0260164 A1 11/2007 Chiodo et al.
2007/0276307 A1 11/2007 Erenstone
2007/0293798 A1 * 12/2007 Hu et al. ..... 602/27
2008/0004558 A1 1/2008 Outred et al.
2008/0060220 A1 * 3/2008 Lyden ..... 36/27
2008/0098626 A1 5/2008 Wright
2008/0154166 A1 6/2008 Beckwith et al.
2008/0294082 A1 11/2008 Chang et al.
2008/0294083 A1 11/2008 Chang et al.
2008/0302371 A1 12/2008 Cohen et al.
2008/0319362 A1 12/2008 Joseph
2009/0043234 A1 2/2009 Bledsoe et al.
2009/0076425 A1 3/2009 Schwartz
2009/0099495 A1 * 4/2009 Campos et al. ..... 602/27
2009/0133292 A1 * 5/2009 Salvatelli et al. ..... 36/110
2009/0192427 A1 7/2009 Brown et al.
2009/0192428 A1 7/2009 DeBoer et al.
2009/0199429 A1 * 8/2009 Ellis ..... 36/29
2009/0227927 A1 9/2009 Frazer
2009/0227928 A1 9/2009 Drake et al.
2009/0264803 A1 10/2009 Darby, II et al.
2009/0287127 A1 * 11/2009 Hu et al. ..... 602/27
2009/0299246 A1 12/2009 Pone et al.
2009/0306565 A1 12/2009 Chan
2010/0010410 A1 * 1/2010 Hu et al. ..... 602/23
2010/0069807 A1 3/2010 Cox
2010/0100018 A1 * 4/2010 Fout ..... 602/13
2010/0204631 A1 8/2010 Rooney
2010/0234782 A1 9/2010 Hu et al.
2010/0324461 A1 12/2010 Darby
2011/0009791 A1 * 1/2011 Hopmann ..... 602/23
2011/0015555 A1 1/2011 Anderson et al.
2011/0021963 A1 1/2011 Graddon et al.
2011/0066095 A1 3/2011 Price et al.
2011/0146032 A1 6/2011 Hu et al.
2011/0196275 A1 8/2011 Chang et al.
2011/0196276 A1 * 8/2011 Kuhn ..... 602/27
2011/0313336 A1 12/2011 Chan
2012/0000092 A1 1/2012 Ingvarsson et al.
2012/0010534 A1 1/2012 Kubiak et al.
2012/0010535 A1 1/2012 Kubiak et al.
2012/0035520 A1 2/2012 Ingimundarson et al.
2012/0065564 A1 3/2012 Hoffmeier
2012/0078148 A1 3/2012 Hu et al.
2012/0116275 A1 5/2012 Pochatko
2012/0137544 A1 * 6/2012 Rosa et al. ..... 36/105
2013/0066247 A1 3/2013 Bird et al.
2013/0226059 A1 * 8/2013 Morris ..... 602/27

FOREIGN PATENT DOCUMENTS

DE 2341658 3/1974
DE 3228753 2/1984
DE 3909922 2/1990
EP 0095396 11/1983
EP 1006960 1/2003
FR 2399811 3/1979
RU 2165229 4/2001

OTHER PUBLICATIONS

Notification of Transmittal of International Search report and the Written Opinion of the International Searching Authority, or the Declaration, International Search Report and Written Opinion in International Application No. PCT/US2012/032710.
PCT Publication No. WO/87/03471, dated Jun. 18, 1987, regarding PCT Application No. PCT/US86/02670.

(56) References Cited

OTHER PUBLICATIONS

Article from http://www.alimed.com regarding AliMed D2 Night Splint for Plantar Fasciitis.
Aircast Incorporated Product Brochure, "SP-Walker, short pneumatic walking brace", Jan. 11, 2002.
PCT Publication No. WO/2012/020251, dated Feb. 16, 2012, regarding PCT Application No. PCT/GB2011/051499.
PCT Publication No. WO/2005/097014, dated Oct. 20, 2005, regarding PCT Application No. PCT/SE2005/000513.
PCT Publication No. WO/2012/099989, dated Jul. 26, 2013, regarding PCT Application No. PCT/US2012/021763.
PCT Publication No. WO/2012/001678, dated Jan. 5, 2012, regarding PCT Application No. PCT/IL2011/000487.
Paul A. Dale, M.D. et al.; "A New Concept in Fracture Immobilization", Clinical Orthopaedics. Oct. 1993, vol. 295: 264-269.

* cited by examiner

REMOVABLE LEG WALKER

CROSS-REFERENCE TO RELATED APPLICATION(S)

This application claims the benefit of U.S. Provisional Patent Application No. 61/472,946, entitled "Removable Leg Walker," filed on Apr. 7, 2011, which is expressly incorporated by reference herein in its entirety.

BACKGROUND

It is common that people, especially active and/or frail people, experience a variety of lower leg and ankle injuries. To aid in the treatment of the injuries it is desirable to immobilize the injury, typically above and below the effected joint.

Physicians traditionally will place patients in a cast that will start at the toes and ends below the knee in what is called a short leg cast. Physicians have noticed that casts are hot, promote skin itching and will rub the leg when the swelling subsides.

An alternative to the short leg cast is a short leg walker that is made of rigid plastic frame lined with a soft padding to accommodate the leg comfortably. Many times the liner, or soft good, may house a series of air bladders that can be adjusted by the patient to improve the fit and help compress the swelling resulting in less pain and more stability. The walkers can be removed when directed to address skin issues, remove sutures or conduct passive range of motion (ROM) exercises. Circumferential casts do not offer the luxury of easy on/off.

Walkers are essentially rigid encasing envelopes for the leg that usually immobilize the foot and ankle at a neutral position (or 90 degrees). The patient can walk easiest if the ankle is frozen at 90 degrees. Otherwise the patient would be walking on the toes or on the heel. The sole is usually tapered from front to back in a rocker bottom fashion to initiate a smoother stride from front to back allowing heel strike, rocking forward then toe-off for a successful step. The sole taper may facilitate forward walking motion, but is not helpful in pivoting to turn.

As shown in FIGS. 1 and 2, a depiction of a prior art orthopedic walking boot 100 having a sole 110 with an edge 115 is shown tilted at an angle, such as may occur when a user wishes to pivot to turn, rather than walk in a straight line. The curvature of the sole 110 at either side includes an arcuate edge 115; however, the radius of curvature of the arcuate edge 115 may conventionally be so small that the contact surface of the sole with the ground at the arcuate edge 115 is too small to afford the user stability in the effort to turn or may even hinder the turn due to effectively balancing on an edge, e.g., like a skate blade. As shown in FIG. 2, a typical ratio of the dimension of a substantially flat portion 112 of the sole 110 having a lateral dimension A to a total lateral dimension B, including the two arcuate edges 115, may conventionally be on the order of 0.85 or greater, meaning that the sole is mostly or substantially flat over 85% of the surface of the sole that may make contact with a walking surface. A limited portion at the arcuate edges 115 having curvature upward toward an upper portion 120 of the boot 100 at the sides makes actual contact with the ground. In this configuration, the shape of the sole tends to resist the effort to pivot into the turn, adding stress and discomfort to the user's leg, which may adversely affect recuperation.

Conventional walker boots typically include a break in the curvature from the bottom surface laterally to the vertical sidewall, and lacks a continuously curved (i.e., rolled) edge. In addition, the sole has no provisions for traction on the sidewalls.

There is a need, therefore, to shape the sole of the orthopedic walker boot to improve the user experience, comfort and mobility.

SUMMARY

In an aspect of the disclosure, an orthopedic walking boot for a user includes an outer sole having a substantially continuously curved lateral profile bottom walking surface, wherein a radius of curvature of the lateral walking surface varies between 10 mm and infinity, and an upper portion arranged with the outer sole to support a leg of the user.

In another aspect of the disclosure, an orthopedic walking boot for a user includes an outer sole having a substantially continuously curved lateral profile bottom walking surface, a traction tread on substantially all of the curved bottom of the outer sole, and an upper portion arranged with the outer sole to support a leg of the user, wherein the sole profile curves substantially continuously to merge with the upper portion.

In a further aspect of the disclosure, an orthopedic walking boot for a user includes an outer sole having a bottom surface with a substantially continuously curved lateral profile and front-to-back rolling curvature, and an upper portion arranged with the outer sole to support a leg of the user.

In a still further aspect of the disclosure, an orthopedic walking boot for a user includes an outer sole comprising a primary material and one or more secondary materials, wherein the secondary materials have a greater shock absorbing characteristic than the primary material.

DETAILED DESCRIPTION

Figure 1:
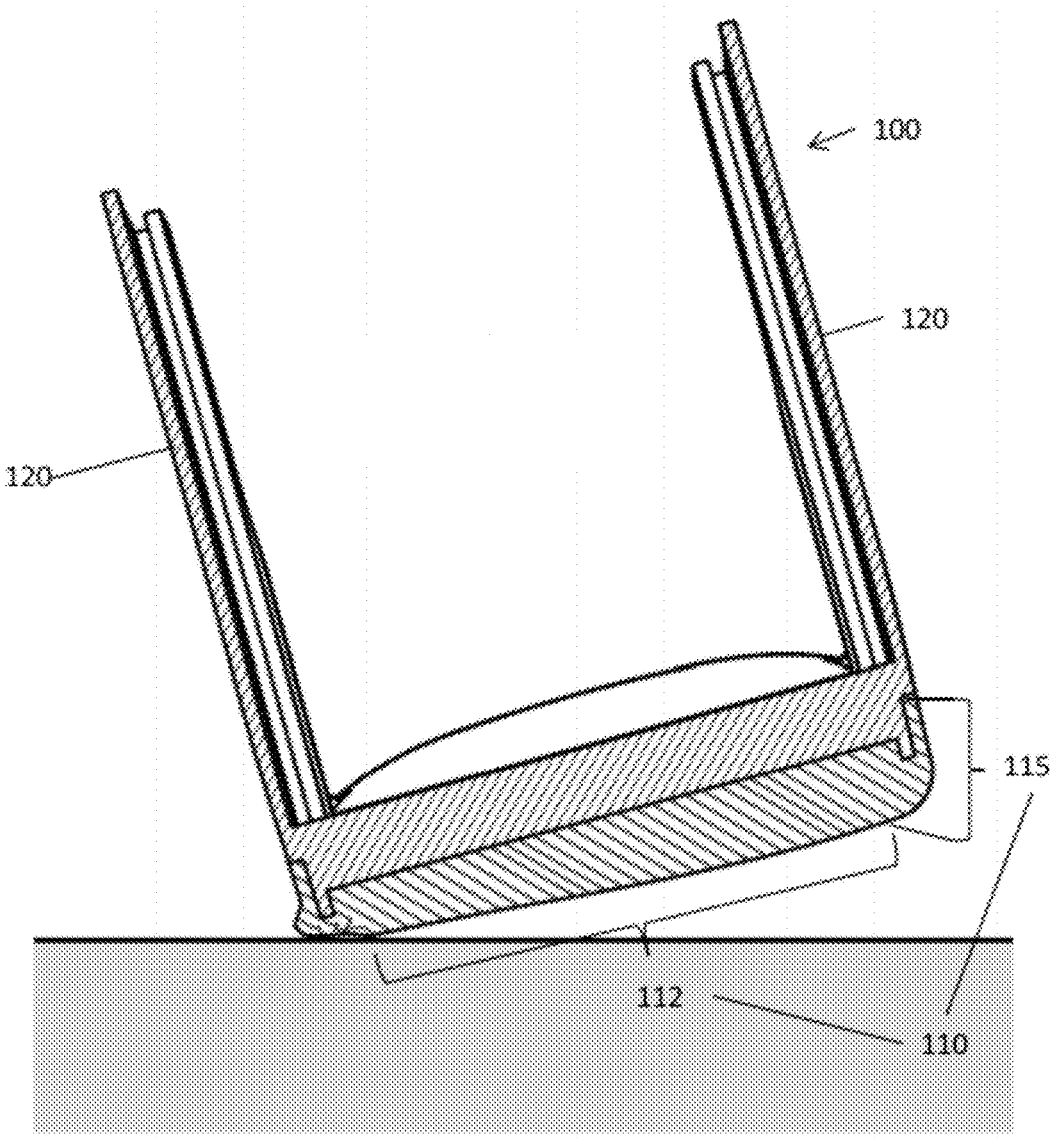
FIG. 1 PRIOR ART
FIG. 1 is a cross-section view of a prior art orthopedic walking boot in contact with a surface.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. Thus, the elements illustrated in the drawings are schematic in nature and their shapes are not intended to illustrate the precise shape of an element and are not intended to limit the scope of the present invention, unless intentionally described as such.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element such as a structure is referred to as being coupled to another element, it can be directly connected to the other element or intervening elements may also be present. Similarly, two elements may be mechanically coupled by being either directly physically connected, or intervening connecting elements may be present. It will be further understood that when an element is referred to as being "formed" on another element, it can be deposited, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if a walker in the drawings is turned over, elements described as being on the "lower" side of other elements would then be oriented on the "upper" side of the other elements. The term "lower", can therefore, encompass both an orientation of "lower" and "upper," depending of the particular orientation of the walker. Similarly, if a walker in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The detailed description set forth below in connection with the appended drawings is intended as a description of various aspects of the present invention and is not intended to represent all aspects in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Various aspects of the present invention may provide an improved short leg walker that may be fitted easily around the leg to provide support and allow ambulation for the affected limb.

Figure 2:
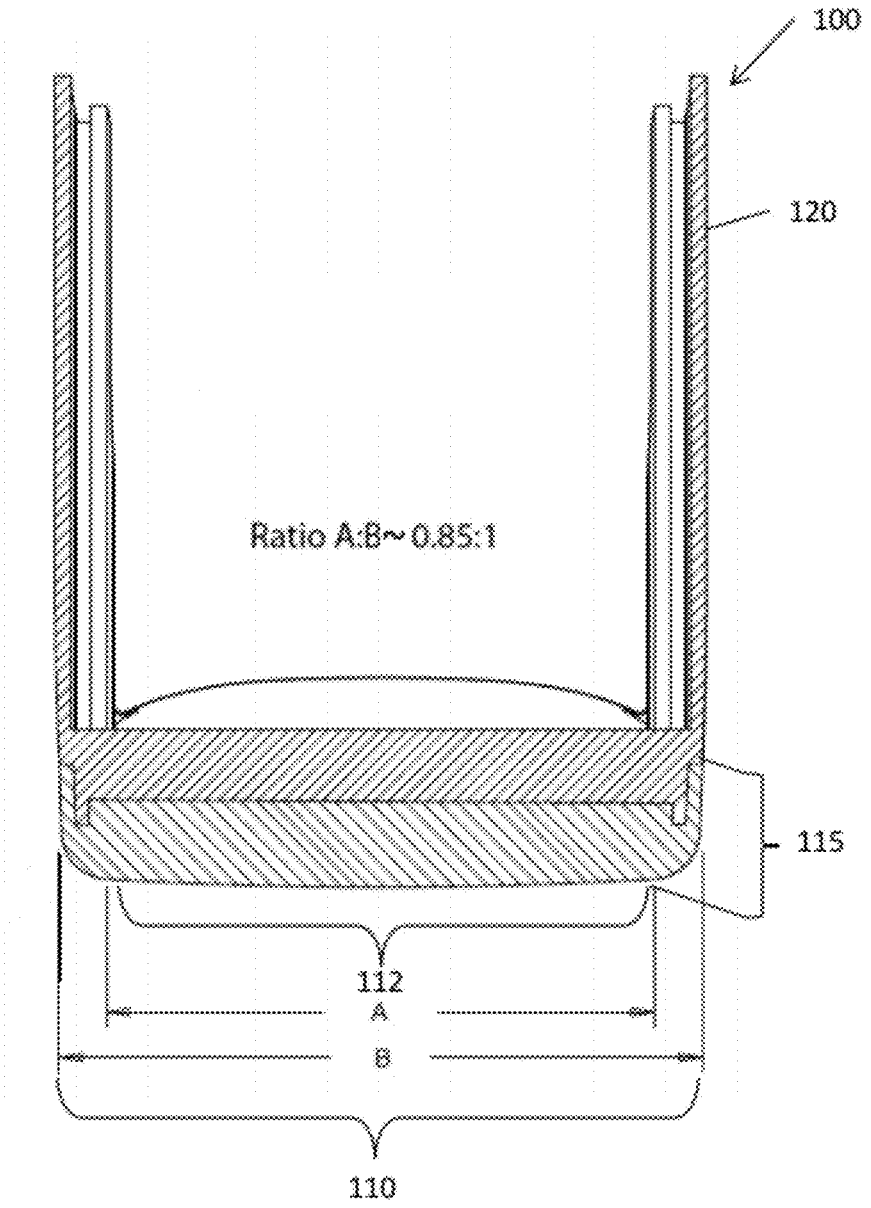
FIG. 2 PRIOR ART
FIG. 2 is a cross-section view of the boot of FIG. 1.
Figure 3A:
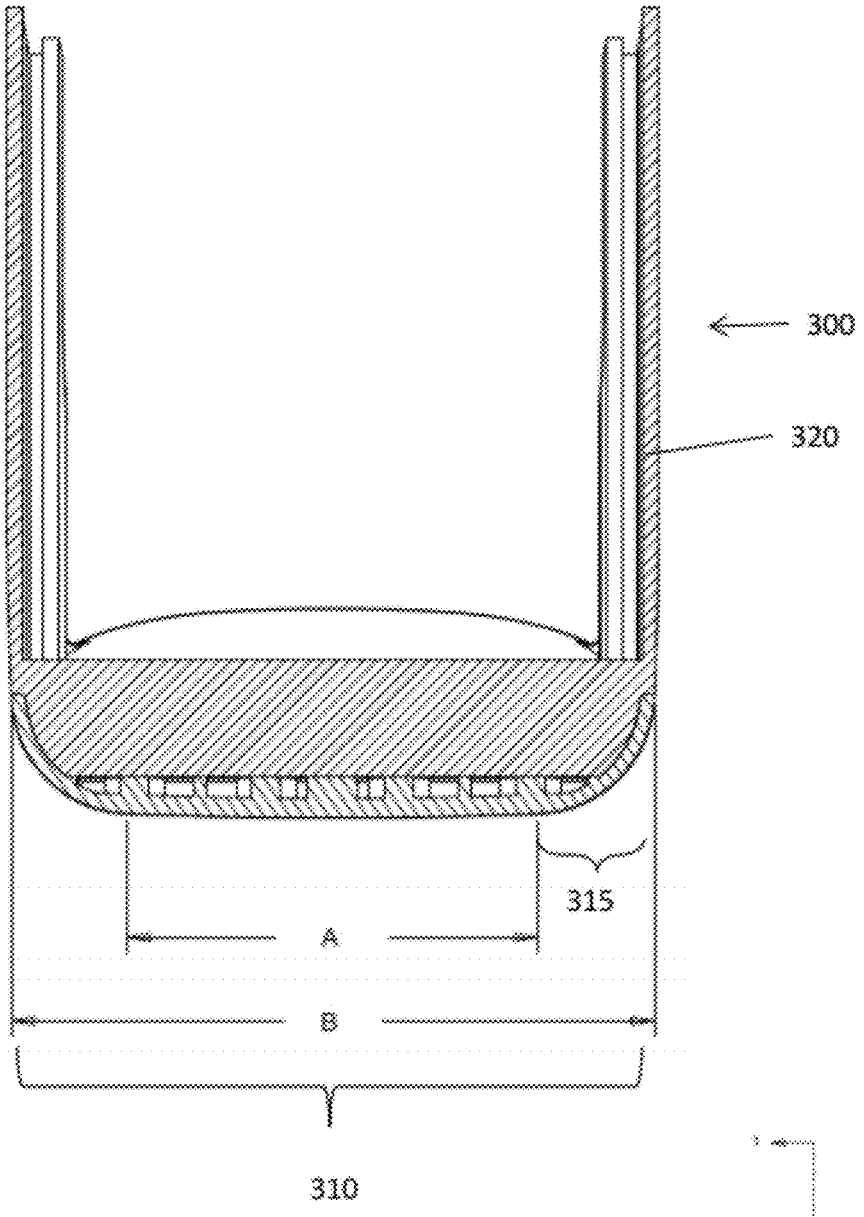
FIG. 3A is a cross-section of an orthopedic walking boot in an aspect of the disclosure.
Figure 3B:
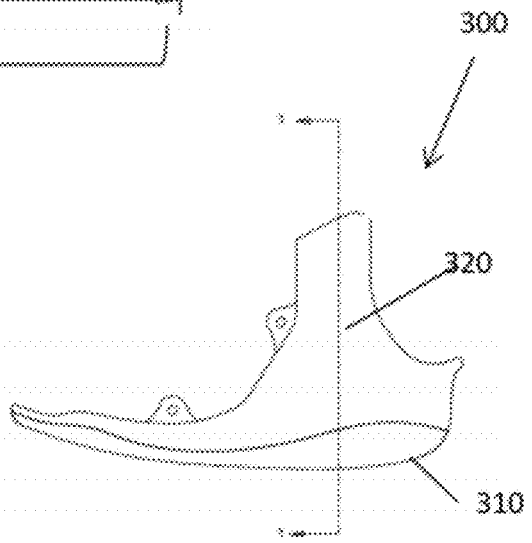
FIG. 3B is a side view of a portion of the orthopedic walking boot of FIG. 3A.

FIG. 3A is a cross-section of an orthopedic walking boot 300 for a lower portion of a user's leg, i.e., from the knee down. As shown in FIG. 3A, a full length outer sole 310 may be rounded at the sides with an arcuate edge 315 where it comes in contact with the walking surface so that the surface of the boot in contact with the ground may transition more smoothly at the edges than may be encountered in a conventional orthopedic walking boot 100. The rounded or arcuate edge 315 disclosed herein allows for the patient to lean more from side to side in the walker to maneuver more easily. With this feature, pivotal rotation of the booted foot is made easier to execute when the user wishes to turn. All portions of the outer sole 310, including the arcuate edge 315, may be fully capable of bearing the weight of the user. Traditionally, outer soles are either a die cut piece of rubber, polyurethane, thermoplastic or like material that is attached permanently to a frame of the walker. These outer soles are usually sloped in the front-to-back direction, as shown in FIG. 3B, for a front-to-back, or longitudinal, rocking action. These outer soles are usually rounded in the front-to-back direction, but not arcuate or rounded in the lateral aspect of the outer sole 310, as shown in FIG. 3A. Because the conventional boot 100 of FIGS. 1 and 2 may usually have a hard angled edge on the lateral sides of the outer sole, the patient, in an effort to assume a natural gait, will actually ride along a portion of the edge, like an ice skate blade, during part of the gait cycle. The problem arises when the patient is on uneven ground, wet surfaces or otherwise unstable surfaces. Because the patient is actually balancing on an edge, it may be more likely that edge becomes cause for the walker to slip, providing a dangerous situation for an already compromised, injured, sometimes weakened, or aged patient.

Because the foot and ankle are set at a specified angle, which may be variable, but typically may be a fixed 90 degree angle, the injured patient may normally adjust his/her gait to not only the frozen angle of the ankle, but to accommodate simultaneously for an angular relationship of the hip to the knee. This causes gross adjustments to the gait/walking patterns, including when the patient pivots to execute a turn. The curved or rounded edge—the arcuate edge 315—will allow for the patient to intuitively adapt to a more normal 3-dimensional gait pattern by being able to roll or use the edge 315 of the walker by leaning the body more side-to-side, as in a healthy walking gait, thus accommodating for the injury as well as the ankle being frozen in a 90 degree angle.

The patient may be more comfortable from the first strides when attempting ambulation in the walker 300. The walker may be beneficially used in a very wide range of injuries and a very wide spectral profile of patient disabilities, e.g., age, physical fitness and/or disabilities, and injury types. For example, a teenage athlete with a broken leg has a very different gate requirement and pain tolerance than an elderly, overweight, health compromised senior citizen who may also suffer other multiple chronic conditions (e.g., arthritis, hip and knee joint degradation, etc.) that can have an additional dramatic effect on gait requirements.

As the injuries progress in healing, the gait pattern may become more aggressive as the pain is eliminated when using the walker 300. Because the patient may be more comfortable at all stages of recuperation, he/she may want to adapt a more natural gait, e.g., walking, twisting, turning quickly, etc. Conscious thought is rarely given to the process of walking in our normal lives. However, people will constantly pivot around a chair, twist when exiting a car, and pivot during normal walking activity when maneuvering around or away from objects and corners, i.e., negotiating normal environments such as the household or work, changing walking surfaces, such as from carpet to hard surfaces, etc. A conventional walker with a sharp cornered arcuate side edge tends to force a wearer to walk in a straight line along that edge. A walker with a more rounded curved side edge allows for less restricted freedom to maneuver more easily. An outer sole with a relatively sharp cornered edge may result in the patient teetering and occasionally slipping or sliding on the edge. The curved surface disclosed herein allows for an easier pivot, roll, turn twist, etc., and improved contact traction on substantially any condition of the walking surface, e.g., snow, ice, rain, oily/slippery surfaces, gravel, rocks, stairs, curbs, all the surfaces we may consistently maneuver on in normal ambulatory activity, to which barely any thought is normally given.

Figure 4:
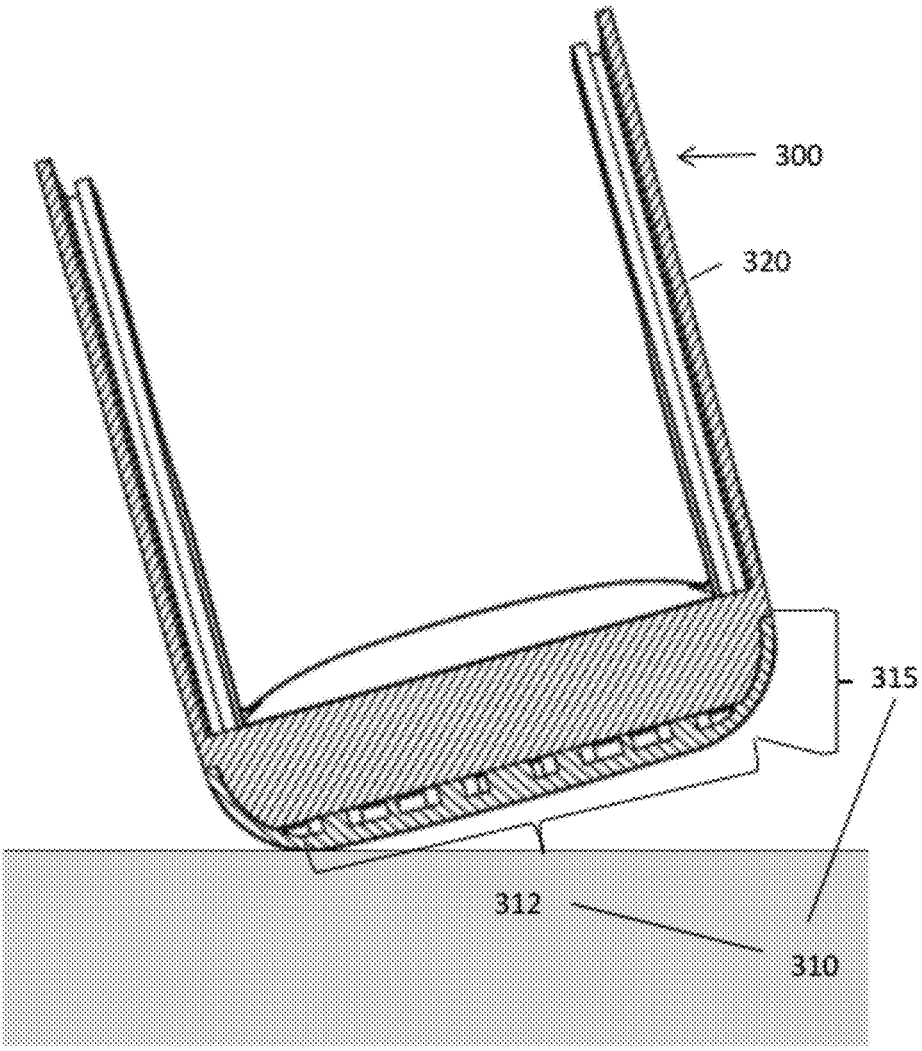
FIG. 4 is a cross-section of the boot of FIG. 3A in partial contact with a surface.

Referring to FIG. 4, the arcuate nature of the walker outer sole 310 may have a lateral profile that is continuous across the width of the entire outer sole 310 and terminate without a substantial step-off between the lateral portion 312 and the arcuate edge 315, thereby being congruent with substantially continuous curvature over the entirety of the outer sole lateral surface profile from the heel striking area to the toe. That is, a lateral portion 312 of lateral dimension A of the sole 315 may have a radius of curvature in the lateral plane that is large enough so as to appear that the lateral portion 312 is approximately or substantially flat. The arcuate edges 315 may have a radius of curvature in a smaller range which is, however still larger than for the arcuate edges 115 of the conventional walker sole 110.

A total dimension B, includes the lateral portion 312 plus the two arcuate edges 315. At the interface between the approximately or substantially flat lateral portion and each of the two arcuate edges 315 the radius of curvature changes to a smaller value, however the surface of the sole has a transition from one portion to the other, with no substantial discontinuous break in contour between the two parts (i.e., between the substantially flat or slightly curved lateral portion of dimension A and the arcuate edge 315) corresponding to a change in slope of the contour break of no more than 20 degrees. Thus, the step-off between the lateral portion 312 and the arcuate edge 315 is restricted to be equal or less than 20 degrees. For example, the radius of curvature may transition between approximately 10 mm in the region of the arcuate edge 315 to a larger value—up to infinity—in the lateral portion 312 of the outer sole 310 indicated by the dimensions A, provided there is no substantial cusp or discontinuity greater than 20 degrees of the surface smoothness from one portion to the other. More preferably, the radius of curvature in the region of the arcuate edge 315 may be approximately 30 cm. This may vary, for example, according to boot size.

A value of the radius of curvature of infinity in the lateral portion 312 indicates a flat portion of the outer sole 310. The radius of curvature in the lateral portion 312 may be in a first range of values from a minimum specified value up to infinity. The radius of curvature in the arcuate edge 315 may be in a second range of values from, for example, the minimum value specified for the lateral portion 312 down to a smaller specified value. The substantially continuous curvature over the entirety of the outer sole lateral surface profile determines that the lateral contour of the outer sole 310 changes smoothly from lateral portion 312 to arcuate edge 315, i.e., with no sharp edges greater than, for example, a 20 degree step-off It may be understood that a tread pattern in the surface of the outer sole 310 may be considered as a perturbation of the surface of the outer sole 310, and is not considered in the definition of the radius of curvature.

In a conventional walker, the ratio A:B may be on the order of $1 \geq A:B \geq 0.85$. Commonly, the ratio may be A:B~0.85. In the walker boot 300 the ratio A:B may be lower, e.g., on the order of $0.85 > A:B \geq 0$. More preferably the ratio A:B may be A:B~0.63.

Another feature is a scalloping or curved recessing on the inside of the walker in the upper portion 320. Traditionally the insides of the walker upper portion 120 are "flat," i.e., lack a contoured surface to accommodate the ankle. The inside of the upper portion 120 of a conventional walker 100 may be interfitted into the flat inside walls in order to provide a secure fitting. Various embodiments of the walker 300 disclosed herein may have a curved or recessed inner surface (not shown) of the upper portion 320 which accommodates the natural curvature of the ankle and foot. This provides a pre-relieved area or recess to accommodate the boney prominences of the foot and ankle and also accommodates swelling patterns that are predictably present with injuries to the area.

In yet another embodiment of the disclosure, the upper portion 320, may be flared outwardly (not shown) to conform to a shape of the wearer's calf, which has an increasing cross-section of the leg with distance from the ankle.

In still another aspect of the disclosure, the outer sole may include a plurality of materials such as, for example, a primary material for structural strength, and one or more secondary materials configured to provide a greater degree of shock absorption to reduce impact stress on the user's foot, particularly from the heal to the mid-foot. The primary and secondary materials may be structurally distinct and separate over the extent of the outer sole to provide different impact characteristics according to location, or alternatively a mixture in various proportions of the primary and secondary materials may provide differing degrees of shock absorption at different locations of the sole of the foot. The mixture may be achieved by controlled additive mixing of secondary materials.

In still another aspect of the disclosure, shock attenuation to the user's foot may be achieved by including the primary and secondary materials as described above in an insole of the walker.

It may be readily appreciated that the walker boot as described above may simultaneously solve a number of deficiencies found in the prior art. These deficiencies in the prior art may include, but are not limited to, an inability to accommodate: a user's supination or pronation tendencies, changes in mobility during recovery, the need for postural accommodations including the hip, knee, back and shoulders, and desired freedom of movement on various terrains, such as, but not limited to, stairs and inclines.

The claims are not intended to be limited to the various aspects of this disclosure, but are to be accorded the full scope consistent with the language of the claims. It is noted that specific illustrative embodiments of the invention have been shown in the drawings and described in detail hereinabove. It is to be understood that various changes and modifications may be made without departing from the spirit and scope of the invention. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. An orthopedic walking boot, comprising:

an upper portion having left and right side walls terminating vertically at a lowermost left and right edges, respectively;

an insole; and an outer sole having:

a longitudinal continuous curvature along an entire length of a lower surface from a front to a back of the outer sole; and a transverse continuous curvature extending from a left uppermost edge to a right uppermost edge and defined by two dimensions A and B, where A is an entire length of the outer sole along a bottom surface in the transverse direction that is substantially flat and substantially parallel to a ground surface when the walking boot is upright, and B is a lateral distance between the left uppermost edge and the right uppermost edge, evaluated at every longitudinal position between a heel strike area and a toe area, said transverse continuous curvature characterized by a ratio of A:B is approximately 0.63.

2. An orthopedic walking boot, comprising:

an upper portion having left and right side walls terminating vertically at a lowermost left and right edges, respectively;

an insole; and an outer sole having:

a longitudinal continuous curvature along an entire length of a lower surface from a front to a back of the outer sole; and a transverse continuous curvature extending from a left uppermost edge to a right uppermost edge and defined by two dimensions A and B, where A is an entire length of the outer sole along a bottom surface in the transverse direction that is substantially flat and substantially parallel to a ground surface when the walking boot is upright, and B is a lateral distance between the left uppermost edge and the right uppermost edge, evaluated at every longitudinal position between a heel strike area and a toe area, said transverse continuous curvature characterized by a ratio of A:B that is less than 0.63.

* * * * *